US006343427B1

(12) United States Patent
Theiss et al.

(10) Patent No.: US 6,343,427 B1
(45) Date of Patent: Feb. 5, 2002

(54) IRONING BOARD WITH SHAPED, FOLDABLE LEGS

(75) Inventors: Burkhard Theiss, Eschenburg; Gunter Elbl, Schorndorf; Dirk Goritzka, Greifenstein, all of (DE)

(73) Assignee: Hailo-Werk Rudolf Loh GmbH & Co. KG Inc., Haiger (DE)

( * ) Notice: Subject to any disclaimer, the term of this patent is extended or adjusted under 35 U.S.C. 154(b) by 0 days.

(21) Appl. No.: 09/799,825

(22) Filed: Mar. 2, 2001

(30) Foreign Application Priority Data

Aug. 29, 2000 (DE) ..... 100 42 284

(51) Int. Cl.[7] ..... D06F 81/02
(52) U.S. Cl. ..... 38/103; 38/DIG. 2
(58) Field of Search ..... 38/137, 103, DIG. 1, 38/DIG. 2; 108/117–119, 131; D32/66

(56) References Cited

U.S. PATENT DOCUMENTS 2,630,360 A * 3/1953 McGinley ..... 38/DIG. 2
2,663,101 A * 12/1953 Olander ..... 38/DIG. 2
2,908,984 A * 10/1959 Lantz
2,912,775 A * 11/1959 Gettelman
5,299,510 A 4/1994 Mattesky ..... 108/117

FOREIGN PATENT DOCUMENTS

DE 19806429 A1 8/1999

* cited by examiner

*Primary Examiner*—Ismael Izaguirre
(74) *Attorney, Agent, or Firm*—Hoffman, Wasson, Gitler

(57) ABSTRACT

An ironing board comprising a preferably height-adjustable stand whose upper end supports an ironing surface, wherein the stand has two hinged legs, and each leg has a foot section that rests at least partially on the base with the ironing board set up, and each leg additionally has a lower section that extends from the foot section to the mid section of the leg, wherein the mid section of the leg extends from the lower section to the upper section of the leg, wherein the upper section of the leg extends from the mid section to under the ironing surface, with the lower section being shaped in such a way as to smoothly flow into the foot section of the leg, wherein the leg is bent by more than 45° in the transitional area between the lower section and foot section, wherein each leg has a first vertex roughly in the area of the hinge linking together the two legs, a third vertex in the transitional area between the lower section and the foot with an angle between the two less than 45°, and a second vertex of the leg is provided between the mid section and the lower section of the legs.

9 Claims, 3 Drawing Sheets

IRONING BOARD WITH SHAPED, FOLDABLE LEGS

CLAIM OF PRIORITY

This application claims priority to German Application Number 100 42 284.5 filed Aug. 29, 2000.

BACKGROUND OF INVENTION

1. Field of Invention

The present invention relates to an ironing board with two hinged legs which fold for storage. The improvement lies in the shape and placement of the legs which provide for more room for the person using the ironing board.

2. The Background Art

A generic ironing board was disclosed in U.S. Pat. No. 5,299,510. In this known ironing board, the leg has an initially straight area at the top, then bends to the outside at an obtuse angle and smoothly flows into a bend in the foot section, where the leg runs transverse to the lengthwise expansion of the ironing surface. In this case, the two legs of the stand are designed in such a way that the bent area of the one leg lies on the one transverse side of the ironing surface viewed in vertical projection, and the bent area of the other leg lies on the opposing transverse side, so that the foot sections extending in the transverse direction extend in a direction opposite the respective other foot section. The disadvantage to this design of the stand is that one area of the leg extends relatively far to the outside on either side of the ironing board stand, so that, with the ironing board set up, users run the risk of tripping over the projecting leg when coming relatively close to the ironing board while ironing. In addition, such a stand does not give the user sitting or standing at the ironing board optimal freedom of movement.

German Patent No. DE 198 06 429 A1 discloses an ironing board with a stand in which the two legs are bent in a wide arc, giving the user sitting or standing at one side of the ironing board more room to move his or her legs. In this ironing board, both foot sections extend in the same direction viewed from the lower end of the leg, namely transverse to the ironing surface. However, the leg and foot section in this ironing board consist of separate tube sections, wherein the lower end of the leg tube section forms a butt joint with the foot tube section, so that the respective tube sections of the leg and foot section must be joined together, e.g., by welding. In this case, it is not possible to bend one half the stand comprised of only one tube section during fabrication. In addition, the shape of the foot sections prevents the stand from optimally standing on the base. Sufficient tilting resistance is also not ensured given certain load situations.

SUMMARY OF THE INVENTION

The object of the present invention is to provide an ironing board in which the stand gives the user abundant room to move his or her legs, while still ensuring a high level of accident safety and tilting resistance for the stand.

In an ironing board according to the invention, the portion of the legs that extend from under the ironing surface to the foot is curved inward like an arc, but not in a single, continuous arc, rather as an upper arc with a first vertex lying roughly in the area of the hinge linking together both legs, with a second vertex of the leg between the first and third vertices, so that the mid section of the leg is bent first in one direction, and then in the other direction, a third vertex lying in the region of the bend of less than 90° where the curved lower section of the leg flows into the foot section. In this case, the bend in both legs is preferably on the same side viewed from the front of the ironing board, so that both foot sections extend from there parallel to the opposing transverse side.

Each of the two legs is preferably an essentially tubular section that extends from under the ironing surface in several bends up to the end of the foot section. Fabrication is particularly easy when the entire leg consists of a continuously bent tube section that is only bent in the appropriate manner during manufacture, so that no joints, welds or the like are necessary. The leg could also be fabricated out of several tube sections, but the latter would then each have a shared axis where jointed, and not butt together at an angle, thus making the legs telescoping.

Due to the fact that at the transition between the upper and mid section the leg is curved in a wide arc whose vertex preferably lies at the height of the hinge, the legs, therefore, provide sufficient legroom on the side of the ironing board where the user is positioned. At the same time, however, the leg is shaped in such a way as to ensure optimal standing safety and tilting resistance of the stand. Since both foot sections extend in the same transverse direction from the transitional area lying only a little above the base(the floor supporting the legs), and the foot sections are themselves relatively flat, there is no danger of someone tripping over the foot sections. The lower sections extend back toward the end of the foot sections in the middle vertex area, thereby giving the user sufficient leg room there as well.

In an embodiment of the legs, the angle between the upper and mid sections is approximately 135° in its bent transitional area viewed from the front of the ironing board, so that the angle between the lower section and the foot section has an acute angle of 45° or less.

At the middle vertex, the angle between mid and lower section of the leg is approximately 90° as viewed from the front of the ironing board, wherein this angle is preferably smaller than the angle between the upper and mid section of the leg.

A turning point lies between the upper vertex, in the hinge area, and middle vertex, in the curved progression of the mid section, wherein the mid section is initially bent in one direction from the bottom of the ironing surface to this turning point, and then bent in the opposite direction under that. The curving direction preferably changes again between the middle vertex and the lower vertex, i.e., in the lower section.

In one preferred structural development of the ironing board according to the invention, a bearing area is established at the foot section by means of a foot piece in the transitional area between the foot and the lower section. Contrary to the prior art described at the outset, a relatively large surface area support is preferably used instead of a point- or linear-shaped support.

Such a relatively large surface area support can be provided by shaping the foot piece roughly like a shoe having the mentioned relatively large surface area support on the bottom and a type of half-shell on top, which can be placed, preferably pressed, on the tubular leg. Such a foot piece is preferably made out of plastic.

The features mentioned in the subclaims relate to further developments of the solution according to the invention. Further advantages of the invention are found in the following detailed description.

BRIEF DESCRIPTION OF THE DRAWINGS

Below, the present invention will be described in greater detail based on embodiments, with reference to the attached drawing.

DETAILED DESCRIPTION OF THE INVENTION

Those of ordinary skill in the art will realize that the following description of the present invention is illustrative only and not in any way limiting. Other embodiments of the invention will readily suggest themselves to such skilled persons.

Figure 1:
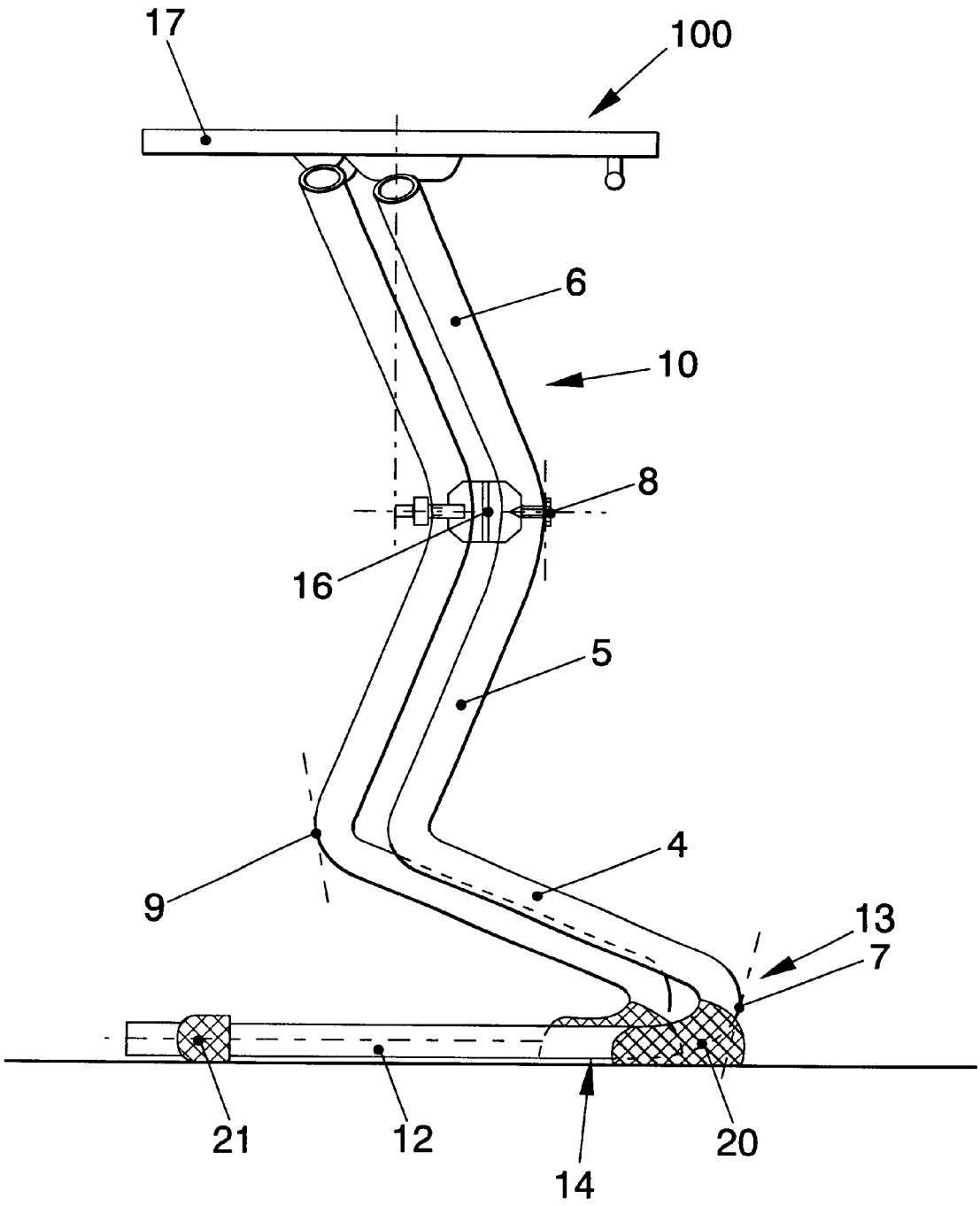
FIG. 1 is a front view of an ironing board according to the invention.

Reference will first be made to FIG. 1.

The figure shows a lengthwise view of an ironing board according to the invention after set up. As evident, the ironing board, designated as 100, has a height-adjustable stand with two legs 10, which are joined together by a hinge 16 like a scissor handle stand, wherein a latch is released to collapse the ironing board, and the two legs 10 are swiveled around the axis of the hinge 16, so that the ironing board then comes to lie flat. This principle of hinged legs is known in the art for ironing boards of this type. FIG. 1 also depicts the ironing surface 17 and the foot pieces 20, which form an initial bearing area on the base. Each of the two legs 10 has a bend in a lower transitional area 13, and makes a transition to a foot section 12 in an unbroken, continuously bent tube progression. At its upper end, the leg 10 extends to under the lower side of the ironing surface 17. The progression of both legs 10 is basically the same, but both legs 10 are slightly offset relative to each other viewed from the front, so that they basically run parallel to each other spaced relatively narrowly apart, wherein the two foot sections 12 of the two legs 10 lie one behind the other on FIG. 1.

Figure 2:
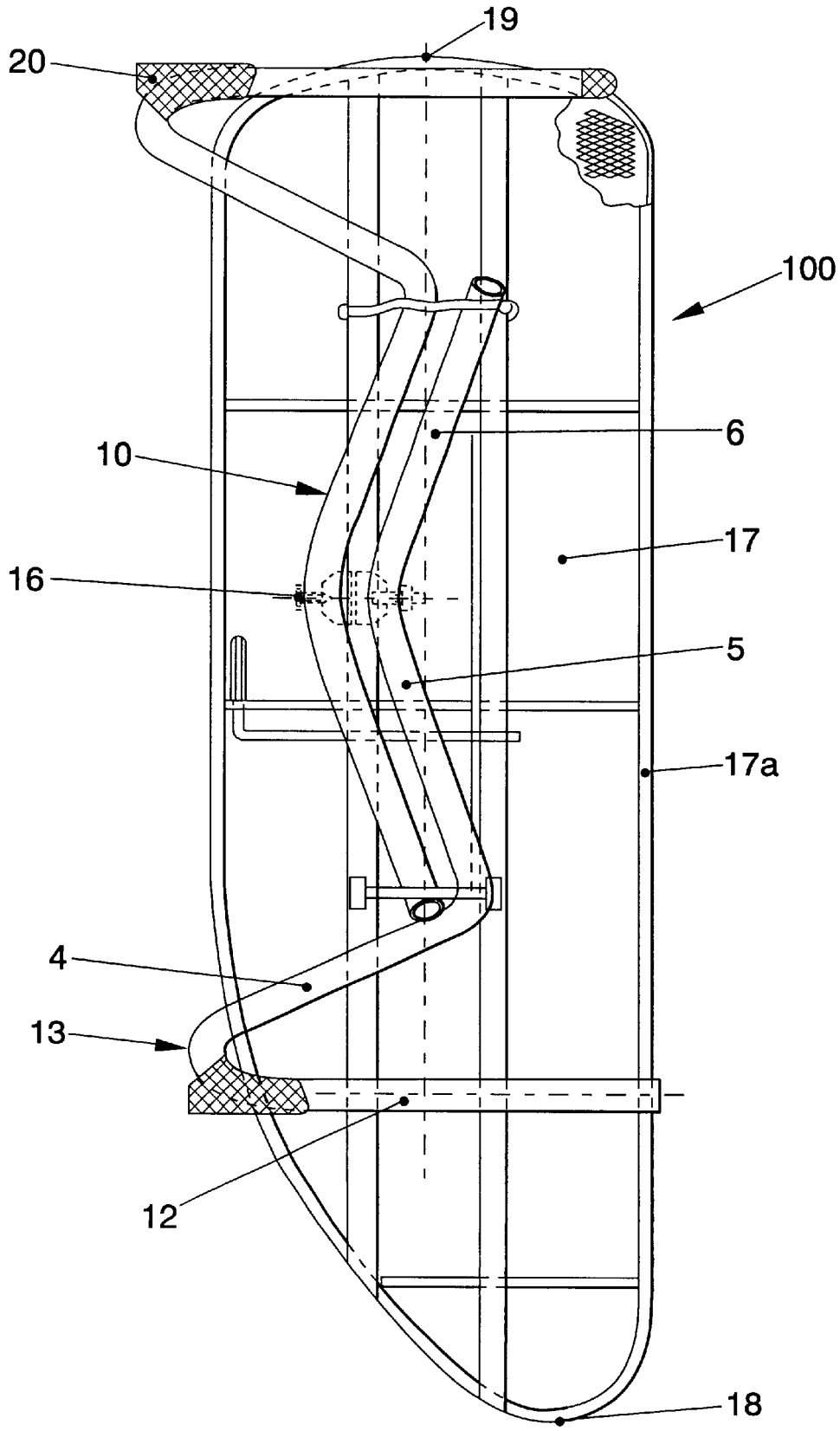
FIG. 2 is a view of an ironing board according to the invention from below the ironing surface, wherein the legs are folded together.

The folded ironing board with legs 10 lying flat under the ironing surface 17 is shown on FIG. 2 from below.

Figure 3:
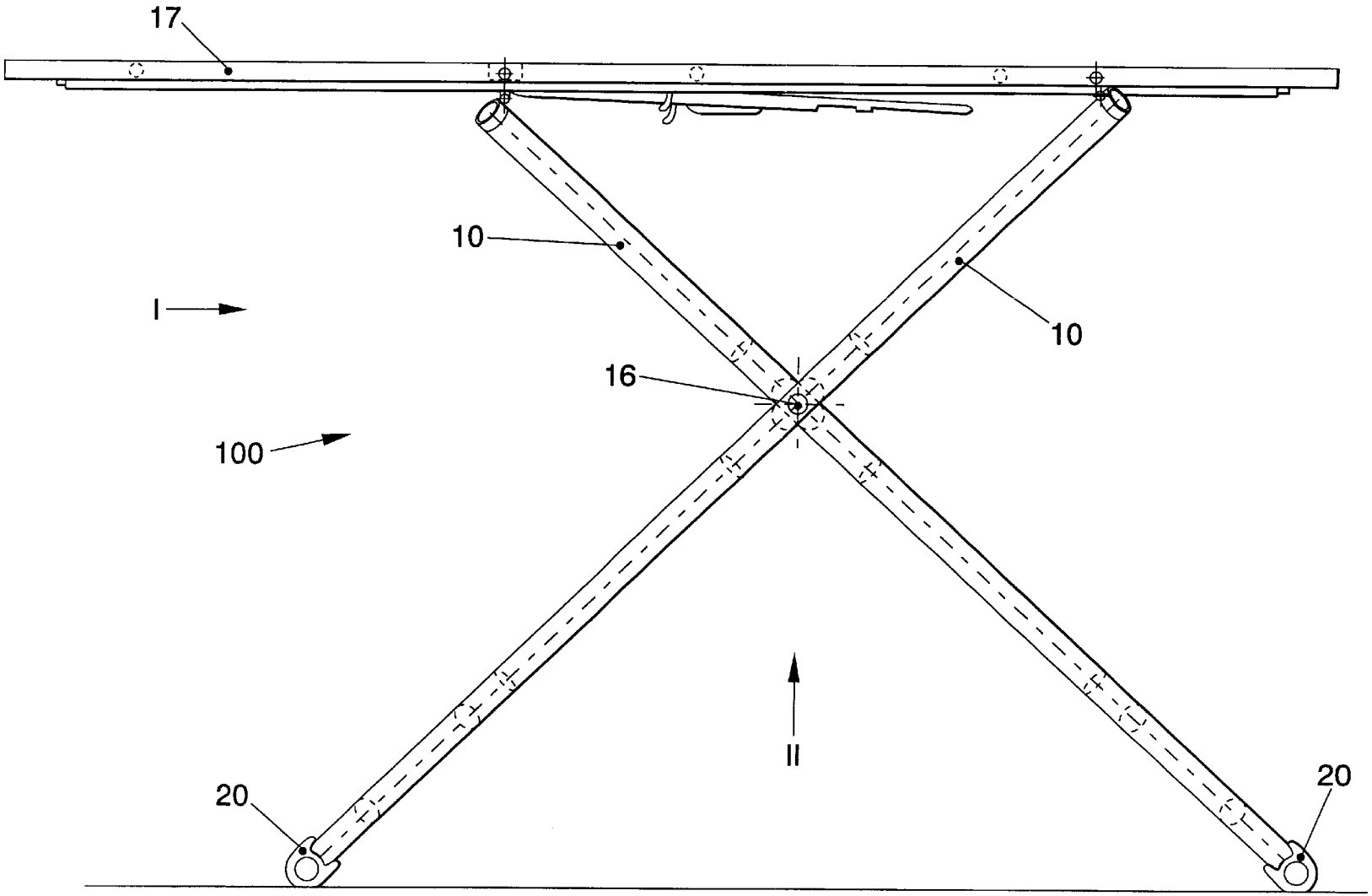
FIG. 3 is a lengthwise view of an ironing board according to the invention.

As shown on FIG. 3, the two legs 10 rest on a base, each with foot pieces 20. When set up, the two legs 10 support the ironing surface 17 at the upper end. The two legs 10 are hinged at their upper end with the lower side of the ironing surface 17. In principle, the two legs 10 are bent tubes consisting of one tube piece, but can also be made up of several tube sections. The shape and curved progression of the bent tubular legs 10 is more readily discernible from FIG. 1 and 2.

The bent tubular progression of the two legs 10 consisting of the upper section 6, mid section 5, lower section 4 and foot section 12 will be described in greater detail below.

In principle, the upper area of the legs 10 encompass an upper section 6, which extends to under the ironing surface 17, wherein this upper section 6 runs at an acute angle to the ironing surface 17 and is initially straight, to then flow into a second segment in a relatively wide arc at roughly the height of hinge 16. The mid section 5 assumes a relatively open, obtuse angle relative to the upper section 6. A first upper vertex 8 lies at roughly the height of hinge 16, wherein the mid section 5 following this bend proceeds in basically a straight line again. As stated, the two sections 5, 6 comprise an obtuse angle relative to each other, and, as shown on FIG. 1, the upper section 6 initially extends toward one side of the ironing surface 17 viewed in the transverse direction, and the mid section 5 then extends roughly the same distance toward the other side again, so that the lower end of the mid section 5 viewed in the vertical projection ends roughly where the upper end of the upper section 6 abuts the bottom side of the ironing surface 17.

The leg 10 again bends under the second segment 5 at a somewhat smaller beading radius, so that a vertex 9 lies there, and the lower section 4 follows more toward the bottom, tracing a flatter line than the overlying mid section 5. The lower section 4 forms an angle with mid section 5 measuring between 90° and 100°. The lower section 4 of the leg 10 then extends further to the outside and inclines downward at an angle of between about 25° and 30° to the horizontal, and ends in a transitional area 13 with a relatively strong bend, wherein this transitional area lies significantly more to the outside than the mid and upper sections 5,6 viewed in the vertical projection. As evident from FIG. 1, the vertex 7 lying in this transitional area 13 even extends beyond the right end of the ironing surface 17 on the drawing in the vertical projection, which gives the ironing board a high stability.

A turning point lies in The bend of The leg 10 between the upper vertex 8 in The hinge area and middle vertex 9, and an additional turning point lies between the middle vertex 9 and the lower vertex 7. In transitional area 13, the tubular supporting leg 10 bends relatively sharply at a relatively small radios, and the ensuing, roughly horizontal foot section 12 again extends in the direction opposite the lower section 4, wherein segment 4 and foot section 12 encompass an angle of roughly 30° relative to each other. In this case, the foot section 12 extends in the opposite transverse direction until it ends in roughly the vertical projection under the end of the ironing surface 17 on the left on the drawing. This also ensures a highly stable stand and a wide bearing area on the base. The end area of the nearly horizontal, tubular foot section 12 has a bearing piece 21, e.g., a plastic cap. The second base support takes the form of the foot piece 20 on the other end of the foot section, which can also consist of plastic, and can be pressed onto the tubular supporting leg 10, for example. In this case, the foot piece 20 can be shaped roughly like a half shell that partially encloses the tubular supporting leg 10, and the side of the foot piece 20 facing the floor has a molded-on, flat bearing area 14, as evident from the drawing.

FIG. 1 also shows that the leg 10 smoothly proceeds from the lower section 4 in the transitional area 13 into foot section 12 at a relatively small bending radius, so that the entire supporting leg 10 with its upper section 6, mid section 5, lower section 4 and foot section 12 can basically only be bent out of a single tube. This enables more cost efficient production. The foot pieces 20 can be shaped roughly like a shoe. FIG. 2 again depicts the collapsed ironing board, wherein the view from below shows the scissor-like stand with the two legs 10. Also evident are its curved shape and the individual, smoothly blending tubular sections of each supporting leg, in particular the upper section 6, the ensuing mid section 5, the lower section 4, the bend in transitional area 13 and the foot section 12. The ironing surface 17 is shaped in such a way as to have a long, straight longitudinal side 17*a*, while the opposing longitudinal side proceeds in a lengthwise stretched arc, ending in a tapered end 18. By contrast, the other end on the opposing front side (transverse side) has an obtuse outline with slightly rounded corner areas. This obtuse end 19 is particularly suited for ironing shoulder areas in shirts, while the tapered end 18 is particularly suited for ironing shirt arms.

What is claimed is:

1. An ironing board comprising:

a planar member, having a width and a length, said length longer than said width, said planar member having an upper substantially planar ironing surface and a lower surface;

a first leg comprising a foot portion, a lower portion disposed in a first plane with and extending from said foot portion and forming a first angle of less than 90° degrees with said foot portion at a first bending radius, a middle portion disposed substantially in said first plane and extending from said lower portion, said middle potion forming a second angle of about 90° with said lower portion at a second bending radius, and an upper portion disposed substantially in said first plane and extending from said middle portion, said upper portion forming a third angle of more than about 90° and less than about 180° with said middle portion at a third bending radius and having an end opposite said third bending radius;

a second leg comprising a foot portion having a length substantially equal to that of said foot portion of said first leg, a lower portion having a length substantially equal to that of said lower portion of said first leg and disposed in a second plane with and extending from said foot portion and forming substantially said first angle with said foot portion at a first bending radius, a middle portion having a length substantially equal to that of said middle portion of said first leg and disposed substantially in said second plane and extending from said lower portion, said middle portion forming substantially said second angle with said lower portion at a second bending radius, and an upper portion having a length substantially equal to that of said upper portion of said first leg and disposed substantially in said second plane and extending from said middle portion, said upper portion forming substantially said third angle with said lower portion at a third bending radius and having an end opposite said third bending radius;

said first and second legs pivotally mounted to one and other along a first z passing through an apex point of said third bending radius of each leg, said first axis bisecting said third angle of each of said first and second legs in their respective planes, wherein said apex points of said first and second legs are oriented in the same direction;

said ends of said upper portions of said first and second legs each pivotally mounted to said lower surface of said planar member along a second and third axes parallel to said first axis, said second and third axes running in a direction substantially parallel to the width of said planar member at locations substantially at the center of the width of said planar member and at least one of said ends of said first and second legs being also slideably mounted to said lower surface of said planar member.

2. The ironing board of claim 1 wherein said foot portions of said first and second legs include substantially flat surfaces downwardly oriented to engage a floor surface.

3. The ironing board of claim 1 wherein said first and second legs each comprise a single piece of material.

4. The ironing board of claim 3 wherein said material is tubular.

5. The ironing board of claim 1 wherein said first angle is less than about 45, said second angle is between about 90 and about a 100, and said third angle is about 135.

6. The ironing board of claim 5 wherein said first angle is between about 25 and about 30.

7. The ironing board of claim 1 wherein the length of said upper portions and said middle portions of said first and second legs are equal to each other.

8. The ironing board of claim 1 wherein the width of said planar member is tapered at at least one end of its length.

9. The ironing board of claim 1 wherein said ends of said upper portions of said first and second legs are located substantially along lines that are perpendicular bisectors of their respective foot portions.

* * * * *